US008262197B2

(12) United States Patent
Hagiwara et al.

(10) Patent No.: US 8,262,197 B2
(45) Date of Patent: Sep. 11, 2012

(54) MANUFACTURING METHOD FOR LIQUID EJECTING HEAD UNIT, AND LIQUID EJECTING APPARATUS

(75) Inventors: Hiroyuki Hagiwara, Matsumoto (JP); Shunsuke Watanabe, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 304 days.

(21) Appl. No.: 12/778,698

(22) Filed: May 12, 2010

(65) Prior Publication Data

US 2010/0289854 A1 Nov. 18, 2010

(30) Foreign Application Priority Data

May 15, 2009 (JP) ..... 2009-119117

(51) Int. Cl.
*B41J 2/15* (2006.01)
*B41J 2/145* (2006.01)

(52) U.S. Cl. ..... 347/40; 347/67; 347/71

(58) Field of Classification Search ..... 347/15, 347/20, 40, 42, 47, 49, 50, 58–59, 65–67, 347/71

See application file for complete search history.

(56) References Cited

U.S. PATENT DOCUMENTS 4,975,143 A 12/1990 Drake et al.
5,923,348 A * 7/1999 Cunnagin et al. ..... 347/42
7,681,985 B2 * 3/2010 Nystrom et al. ..... 347/42

FOREIGN PATENT DOCUMENTS

JP 03-177042 8/1991
JP 2549762 8/1996

* cited by examiner

*Primary Examiner* — Thinh Nguyen
(74) *Attorney, Agent, or Firm* — Workman Nydegger

(57) ABSTRACT

A liquid ejecting head unit includes liquid ejecting heads, each having a row of nozzles that eject liquid. The liquid ejecting heads are anchored to a base plate. An anchoring plate is anchored to the base plate and positions the liquid ejecting heads relative to the base plate. A reference mark is formed in the anchoring plate and a positioning mark is formed in the base plate for positioning the anchoring plate relative to the base plate. The positioning marks are formed along the direction in which the nozzles are arranged in a row. A related manufacturing method includes selecting the positioning mark in accordance with a predetermined resolution and anchoring the anchoring plate to the base plate so that the reference mark and the selected positioning mark are in the same relative positional relationship. The liquid ejecting heads are anchored to the base plate using the anchoring plate.

13 Claims, 8 Drawing Sheets

MANUFACTURING METHOD FOR LIQUID EJECTING HEAD UNIT, AND LIQUID EJECTING APPARATUS

BACKGROUND

1. Technical Field

The present invention relates to a manufacturing method for a liquid ejecting head unit and a liquid ejecting apparatus.

2. Related Art

Liquid ejecting apparatuses, as represented by ink jet recording apparatuses such as ink jet printers, plotters, and so on, include liquid ejecting head units in which multiple liquid ejecting heads capable of ejecting a liquid such as ink held in a cartridge, a tank, or the like as droplets from a nozzle are provided.

Each of the multiple liquid ejecting heads of which such a liquid ejecting head unit is configured are anchored to a base plate, which is a shared holding member, in a state in which they are positioned in predetermined positions with high accuracy. For example, the liquid ejecting heads are anchored to the base plate along the direction of nozzle rows in which multiple nozzles of the liquid ejecting heads are arranged, and are positioned with high accuracy so that the nozzles are arranged continuously at a constant pitch.

As a method for positioning liquid ejecting heads and manufacturing a liquid ejecting head unit, there is, for example, a method in which key grooves and keys are respectively formed through photolithography in an alignment substrate configured from a silicon substrate (this corresponds to the base plate) and subunits disposed thereupon (these correspond to the liquid ejecting heads), and the subunits are positioned in predetermined positions upon the alignment substrate and attached thereto having fitted the keys into the key grooves (for example, see JP-B-2549762).

According to a method such as this, the liquid ejecting heads can be positioned with high accuracy and anchored to the base plate. However, with the method disclosed in JP-B-2549762, in the case where higher resolutions are to be obtained by disposing the liquid ejecting heads so as to be shifted in the nozzle row direction, it is necessary to form the key grooves based on the desired resolution, which leads to an increase in the number of components. There is thus a problem that this results in higher costs.

It should be noted that this problem is not limited to ink jet recording heads, and is also present in other liquid ejecting head units that eject liquids aside from ink.

SUMMARY

An advantage of some aspects of the invention is to provide a manufacturing method for a liquid ejecting head unit capable of anchoring liquid ejecting heads to a base plate in accordance with a resolution while maintaining a favorable positioning accuracy and without increasing the number of components, and to provide a liquid ejecting apparatus that uses this liquid ejecting head unit.

A manufacturing method for a liquid ejecting head unit according to an aspect of the invention is a manufacturing method for a liquid ejecting head unit that includes: a plurality of liquid ejecting heads, each liquid ejecting head having a nozzle row in which nozzles that eject a liquid are arranged in a row; a base plate to which the plurality of liquid ejecting heads are anchored; an anchoring plate, anchored to the base plate, for positioning the liquid ejecting heads in predetermined positions relative to the base plate; and a reference mark formed in the anchoring plate and a positioning mark formed in the base plate for positioning the anchoring plate relative to the base plate. A plurality of the positioning marks are formed along the direction in which the nozzles are arranged in a row, and the manufacturing method includes: selecting the positioning mark in accordance with a predetermined resolution; anchoring the anchoring plate to the base plate so that the reference mark and the selected positioning mark are in the same relative positional relationship; and anchoring the liquid ejecting heads to the base plate using the anchoring plate. Forming multiple positioning marks and selecting the positioning marks in accordance with a predetermined resolution makes it possible to manufacture head units having different resolutions with ease; it is thus unnecessary to manufacture components based on the resolution, thus making it possible to achieve a reduction in costs.

According to another aspect of the invention, it is preferable for the positioning marks to be holes that are formed in the base plate.

Here, it is preferable for at least one of the shape and size of the positioning marks to differ in each of positioning marks. Forming the positioning marks in this manner makes it easy to recognize which positioning marks are selected, and thus makes it easier to manufacture the head unit.

Furthermore, it is preferable for a plurality of rows of the positioning marks to be formed in the anchoring plate along the direction that is orthogonal to the direction in which the nozzles are arranged in rows. Providing a plurality of rows in this manner makes it easy to carry out positioning relative to the reference marks.

Furthermore, it is preferable for a positioning pin to be provided in the anchoring plate, and a through-hole through which the positioning pin passes to be provided in each of the liquid ejecting heads; and for each of the liquid ejecting heads to be anchored to the base plate by passing the positioning pin through the through-hole. According to this aspect of the invention, the liquid ejecting head can be positioned with ease using the positioning pin, and anchored.

A liquid ejecting apparatus according to another aspect of the invention includes a liquid ejecting head unit manufactured through one of the manufacturing methods for a liquid ejecting head unit described above. Using the manufacturing method for a liquid ejecting head unit according to the invention makes it possible to anchor liquid ejection heads to a base plate in accordance with a resolution while maintaining a favorable positioning accuracy and without increasing the number of components, and thus the liquid ejecting apparatus has favorable liquid ejection properties.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
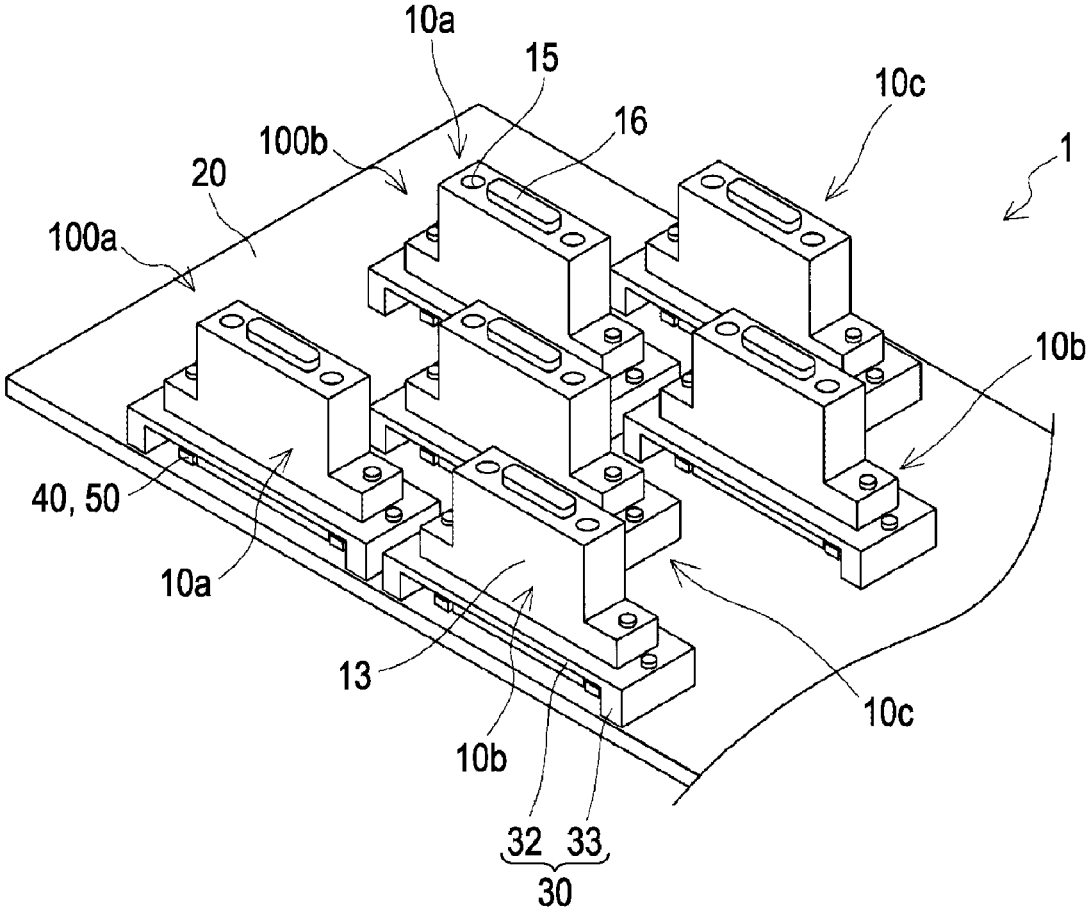
FIG. 1 is a perspective view illustrating an outline of a head unit.
Figure 2:
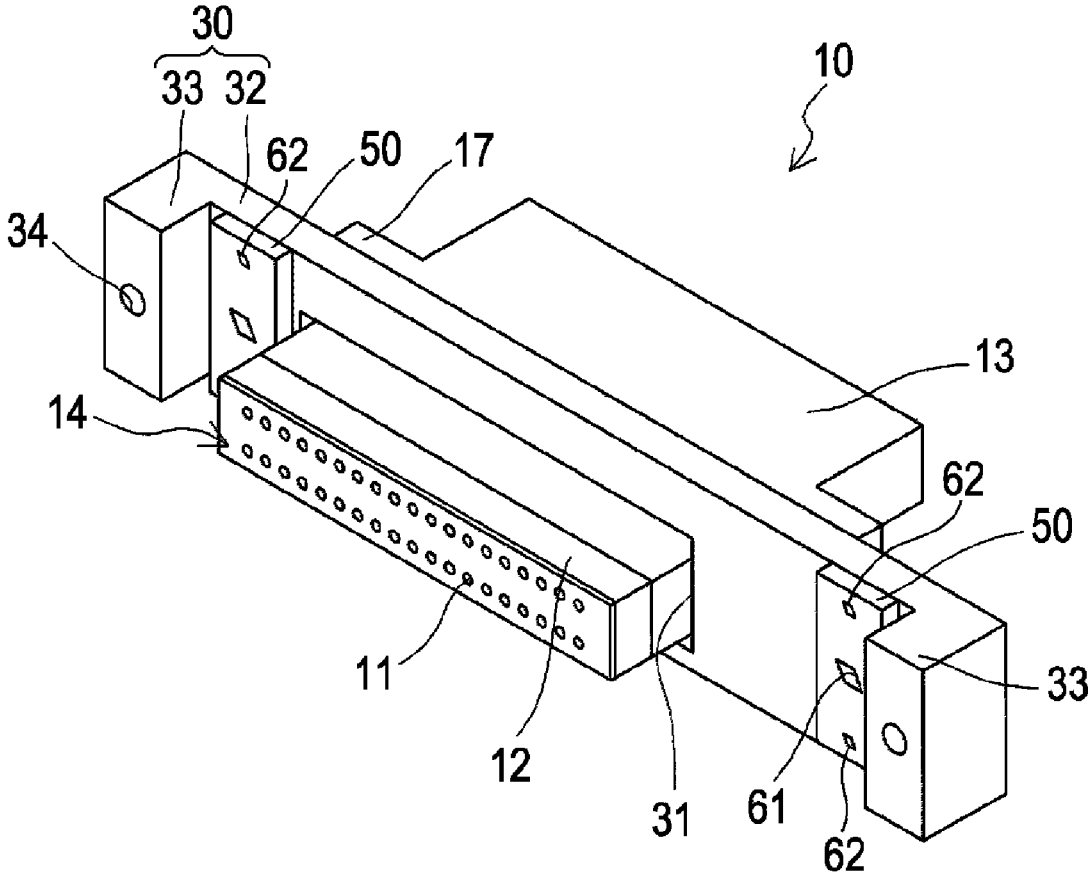
FIG. 2 is a perspective view illustrating an outline of a head.

The invention will be described in detail hereinafter based on embodiments.

As shown in FIGS. 1 through 4, an ink jet recording head unit 1 according to this embodiment (also called simply a head unit hereinafter) includes head groups 100 configured of multiple ink jet recording heads 10 (also called simply heads hereinafter) and a base plate 20 onto which the multiple heads 10 are anchored having been positioned in predetermined positions.

Nozzles 11 are arranged at a constant pitch in one direction in each of the heads 10, thereby forming nozzle rows 14. Each head group 100 is configured by disposing multiple heads 10 (in this embodiment, heads 10*a*, 10*b*, and 10*c* as an example) so as to follow the direction of the nozzle rows 14. The multiple heads 10*a*, 10*b*, and 10*c* of which each head group 100 is configured are disposed in a houndstooth pattern. In other words, the heads 10*a* and the heads 10*b* are disposed in a row following the nozzle row direction, whereas the heads 10*c* are shifted relative to the heads 10*a* and the heads 10*b* in the direction orthogonal to the nozzle row direction, and furthermore, the ends of the nozzle rows 14 in the heads 10*a* on the side of the heads 10*b* and the ends of the nozzle rows 14 in the heads 10*b* on the side of the heads 10*a* are disposed so as to overlap with the ends of the nozzle rows 14 in the heads 10*c* (disposed so as to be in the same position in the direction that is orthogonal relative to the nozzle rows 14). Disposing the heads in such a manner ensures that the nozzles 11 are not interrupted in the direction in which the nozzle rows 14 are arranged. The multiple head groups 100 configured in this manner (in this embodiment, two head groups 100*a* and 100*b*, as an example) are arranged in parallel upon the base plate 20 in the direction orthogonal to the nozzle rows 14.

Through-holes 21 are provided in the base plate 20 passing therethrough in the thickness direction thereof, and are provided corresponding to each of the heads 10. In other words, each head 10 is anchored to the base plate 20 in a state in which the head 10 communicates with its corresponding through-hole 21.

Each head 10 includes a head main body 12 having multiple nozzles 11 on the surface of one end thereof, and a head case 13 anchored to the surface of the head main body 12 on the side thereof that is opposite to the side on which the nozzles 11 are provided. For example, in this embodiment, two nozzle rows 14 in which the nozzles 11 are arranged are provided in the head main body 12. Meanwhile, although not shown in the drawings, a pressurizing chamber that partially configures a channel that communicates with the nozzles 11 and a pressure generation unit that causes a pressure change within the pressurizing chamber, thereby causing ink to be ejected from the nozzles, are provided in the interior of the head main body 12.

Although the pressure generation unit is not particularly limited, a piezoelectric element in which a piezoelectric material providing an electromechanical conversion function is sandwiched between two electrodes, a scheme that provides a heat generating element within the pressurizing chamber and causes liquid to be ejected from the nozzles 11 by bubbles generated by the heat produced by the heat generating element, a scheme that produces static electricity between a vibrating plate and an electrode and causes liquid to be ejected from the nozzles 11 by deforming the vibration plate as a result of the electrostatic force, and so on can be used as the pressure generation unit. Furthermore, a flexural vibration piezoelectric element in which a lower electrode, a piezoelectric material, and an upper electrode are layered in that order from the side of the pressurizing chamber and are caused to flexurally deform, a vertically vibrating piezoelectric element in which piezoelectric materials and electrode-forming materials are layered in an alternating manner and are caused to expand/shrink in the axial direction thereof, and so on can be used as piezoelectric elements.

The head case 13 includes a supply channel 15 for supplying ink from an ink holding unit such as an ink tank or the like (not shown) to the head main body 12. Meanwhile, driving wiring (not shown) connected to the aforementioned piezoelectric element and so on is contained within the head case 13, and a connector 16 to which this driving wiring is connected is provided on the surface of the head case 13 that is on the side opposite to the head main body 12.

The heads 10 are anchored to the base plate 20 via a subplate 30. The subplate 30 is configured of a base portion 32, in which a head through-hole 31 is provided, and leg portions 33 that protrude from the base portion 32 toward the side on which the nozzles 11 are provided. The subplate 30 is anchored to the head 10 in a state in which the head 10 passes through the head through-hole 31. To be more specific, the base portion 32 of the subplate 30 is anchored to a flange portion 17 provided around the outer circumference of the head case 13 using anchoring screws 18.

Anchoring screw-holes 34, through which anchoring screws 35 are passed, are formed in the leg portions 33 of the subplate 30 in the thickness direction thereof. The subplate 30 is anchored to the base plate 20 by these anchoring screws 35. In other words, anchoring member through-holes 22, into which the anchoring screws 35 are threaded, are provided in the base plate 20 on the outer side of an anchoring plate 40 (mentioned later), which is the side opposite to the side on which the heads 10 are formed.

Each head 10 that is anchored to the base plate 20 by the subplate 30 in this manner is positioned with high accuracy using positioning pins 23 that are anchored to the base plate 20, as will be described hereinafter.

Figure 3:
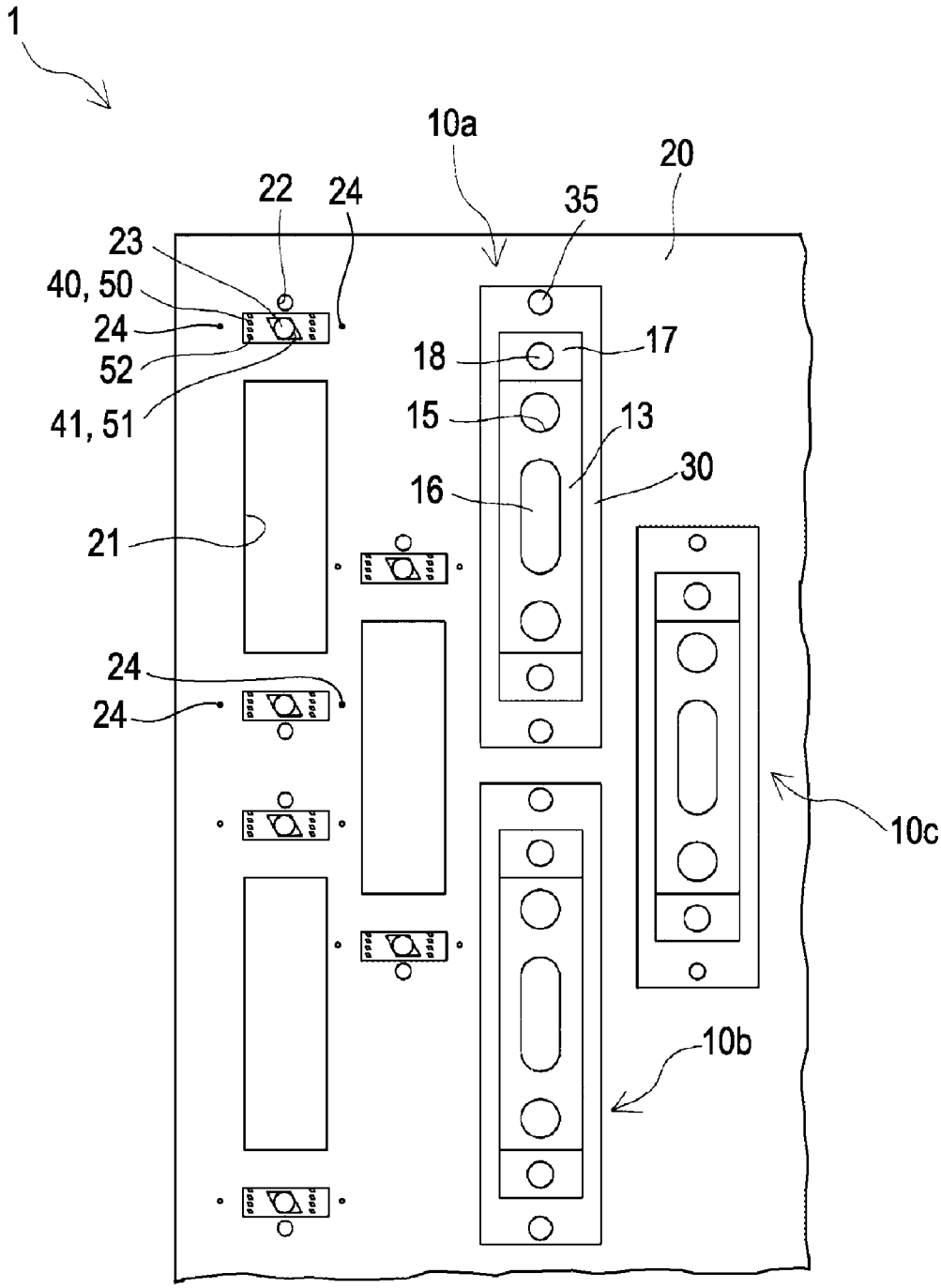
FIG. 3 is a plan view illustrating an outline of a head unit.
Figure 4:
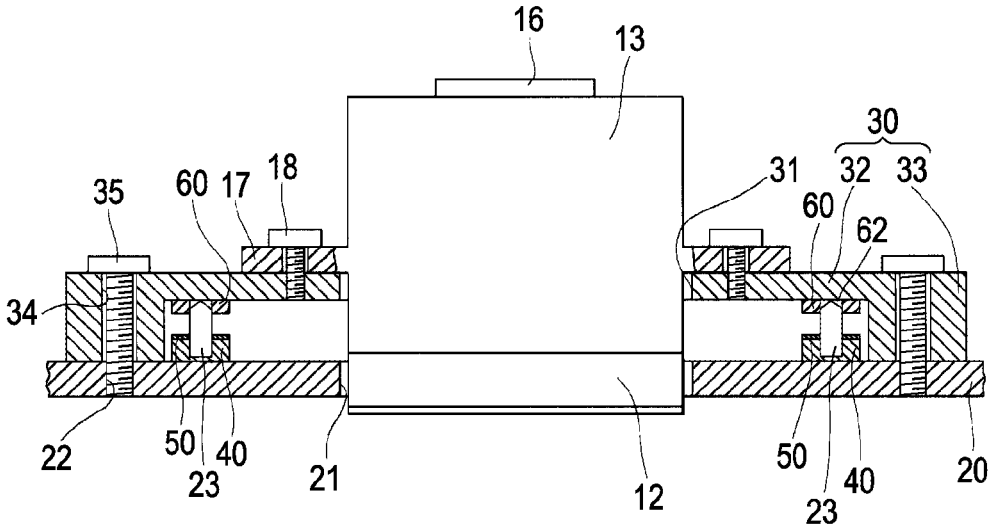
FIG. 4 is a cross-section illustrating an outline of a head unit along a nozzle row direction.

As shown in FIGS. 3 and 4, a pair of positioning pins 23 are configured of, for example, a metallic material, and are each anchored to an anchoring plate 40. Each anchoring plate 40 is anchored to the base plate 20 at a predetermined position having been positioned with high accuracy using a pair of reference holes (reference marks) 24 and positioning holes (positioning marks) 52 formed in the base plate 20. Although details will be given later, positioning the anchoring plates 40 relative to the base plate 20 at high accuracy using the positioning holes 52 also positions the positioning pins 23 relative to the base plate 20 with high accuracy, and thus it is possible to position the heads 10, which are positioned using these positioning pins 23, relative to the base plate 20 with high accuracy. To be more specific, the anchoring plates 40, on which the positioning pins 23 are anchored, are positioned with high accuracy and anchored to the base plate 20 in regions thereof on both sides of the through-holes 21 in the direction of the nozzle rows 14. Note that any mark that can be used as a reference can be employed as the reference holes 24; the reference holes 24 can be formed using etching, a laser, or the like, and the shape and so on thereof is not particularly limited.

Each anchoring plate 40 has a holding hole 41 bored in a direction that is approximately vertical relative to the surface of the anchoring plate 40, and the positioning pin 23 is held having passed through this holding hole 41. In other words, the positioning pin 23 is held by this holding hole 41, and is thus held at a desired vertical posture relative to the anchoring plate 40. Of course, as will be described later, as long as the positioning pin 23 can be anchored to the anchoring plate 40 in a favorable manner, the positioning pin 23 does not necessarily have to be pressed into the holding hole 41, and the material of the anchoring plate 40 is also not particularly limited. However, in consideration of the accuracy of the machining of the holding hole 41 and so on, it is preferable to use a metallic material as the material of the anchoring plate 40.

Note also that the method for anchoring the anchoring plate 40 to the base plate 20 is not particularly limited, and although not shown in the diagrams, the anchoring plate 40 may be anchored using, for example, a connecting member such as a screw or the like provided from the side of the base plate 20.

A reference plate 50 configured of a silicon substrate is affixed to the surface of the anchoring plate 40. A through-hole 51 through which the positioning pin 23 is passed is formed in the reference plate 50. In other words, the through-hole 51 communicates with the holding hole 41 in a state where the reference plate 50 is affixed to the anchoring plate 40. In addition, the through-hole 51 is formed at a size whereby the positioning pin 23 substantially makes contact with the inside thereof. Furthermore, positioning holes 52 that serve as references for positioning the anchoring plate 40 (positioning pin 23) relative to the base plate 20 are also formed in the reference plate 50.

The reference plate 50 is configured of, for example, a silicon single-crystal substrate of crystal plane orientation (110), and the through-holes 51 and the positioning holes 52 are formed by performing anisotropic etching on the silicon single-crystal substrate. Because the through-hole 51 and the positioning holes 52 are formed in the silicon substrate through etching in this manner, the through-hole 51 and the positioning holes 52 can be positioned with high accuracy relative to each other. Therefore, by positioning the respective anchoring plates 40 relative to the base plate 20 using the positioning holes 52 and the reference holes 24 formed in the base plate 20 as references, the positioning pins 23 anchored to the anchoring plates 40 can be positioned in the planar direction of the base plate 20 with extremely high accuracy.

Note that the positioning holes 52 are formed for reasons such as those described hereinafter. That is, if the nozzles 11 are disposed at a high density, it is necessary to position each head 10 with extremely high accuracy, on the micron order. The positioning of the positioning pins 23 (anchoring plates 40) is carried out through, for example, an image processing using a CCD camera or the like, and if the nozzles 11 are disposed at a high density as mentioned above, it is necessary to process the image at an extremely high rate of magnification. Accordingly, it is difficult to use the through-hole 51, which has a comparatively large opening and through which the positioning pin 23 is passed, as a reference, and thus it is necessary to use the positioning holes 52, which are formed separately, as references.

In this invention, the reference plate 50 configured of a silicon substrate is provided on the surface of the anchoring plate 40 as described above, and the through-hole 51 and positioning holes 52 are formed in this reference plate 50; therefore, the through-hole 51 and the positioning holes 52 are positioned relative to each other with high accuracy. Accordingly, using the positioning holes 52 as a reference makes it possible to position the through-hole 51, or in other words, position the positioning pin 23 (anchoring plate 40) with high accuracy.

The material of the reference plate 50 is not limited to a silicon single-crystal substrate, and the material may be a thin metallic plate that has undergone fine press machining, a similar thin metallic plate that has undergone wire electric discharge machining, or the like. The same effects can be achieved even when using a reference plate 50 formed in such a manner. In other words, it is not necessary to limit the material of the reference plate 50 to any specific material as long as the material is capable of undergoing highly accurate fine machining.

Meanwhile, a positioning plate 60, in which a tip through-hole 61 through which the tip of the positioning pin 23 passes is formed, is attached to the surface of the base member 32 of the subplate 30 on the side on which the nozzles 11 are provided. This positioning plate 60 is anchored to the subplate 30 so that the tip through-hole 61 is positioned relative to the nozzles 11 with high accuracy.

The positioning plate 60 is, like the aforementioned reference plate 50, configured of a silicon substrate, and includes a second positioning hole 62 positioned with high accuracy relative to the tip through-hole 61. In other words, the tip through-hole 61 and the second positioning hole 62 are formed by, for example, performing anisotropic etching on a silicon substrate of crystal plane orientation (110). The positioning plate 60 is then anchored to the subplate 30 through, for example, image processing, in a state in which the tip through-hole 61 is positioned at high accuracy using the second positioning hole 62 as a reference.

Note that it is preferable to use, for the material of the positioning plate 60, a silicon substrate in which the tip through-hole 61 and the second positioning hole 62 can be formed with high accuracy, as described above; however, the material of the positioning plate 60 is not particularly limited as long as the tip through-hole 61 and the second positioning hole 62 can be formed with high accuracy.

According to the configuration of this embodiment as described thus far, when anchoring the heads 10 (subplates 30) to the base plate 20, the heads 10 can be positioned relative to the base plate 20 with high accuracy simply by passing the tips of the positioning pins 23 that are anchored to the base plate 20 through predetermined tip through-holes 61. Accordingly, operations for exchanging the heads 10 are extremely simple. In other words, it is no longer necessary to position the heads 10 using a CCD camera or the like, which makes it possible to align the heads 10 easily, without requiring time or effort. Accordingly, exchange operations can be implemented in a comparatively easy manner even in the case where, for example, the operation for exchanging the heads 10 is carried out at a location where a liquid ejecting apparatus provided with the head unit 1 is actually used.

Incidentally, in this embodiment, multiple positioning holes 52 are formed in the reference plate 50 (52*a* to 52*d*). By forming multiple positioning holes 52 in this manner, with the head unit 1 according to this embodiment, each head group 100 can be anchored to the base plate 20 while shifting the locations where the groups are disposed on a group-by-group basis, thereby making it possible to improve the resolution without increasing the number of components. This point will be described in more detail hereinafter using FIGS. 5 through 7.

Figure 5:
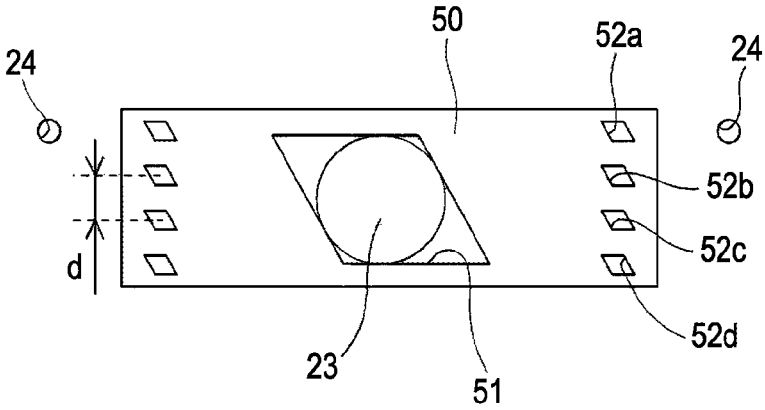
FIG. 5 is a partial enlarged diagram illustrating a base plate.

As shown in FIG. 5, the positioning holes 52*a* to 52*d* are formed in the vicinity of the lengthwise direction ends of the reference plate 50 in which the through-hole 51, through which the positioning pin 23 passes, is formed. To be more specific, the positioning holes 52*a* to 52*d* are formed on both ends of the reference plate 50 in the lengthwise direction, the positioning holes being in a row that follows the widthwise direction of the reference plate 50. In other words, two rows of positioning holes 52 are formed, and each row is configured of four positioning holes 52.

These positioning holes 52 are formed with a predetermined space d (an inter-center distance between adjacent positioning holes) provided therebetween in the direction orthogonal to the nozzle row direction. The interval d between the positioning holes 52*a* to 52*d* is ¼ the pitch between each nozzle 11 (an inter-nozzle 11 distance). In this embodiment, the resolution of the head unit 1 can be changed by selecting, during the manufacturing process, which of the positioning holes 52*a* to 52*d* will be positioned relative to the reference holes 24 formed in the base plate 20.

Figure 6A:
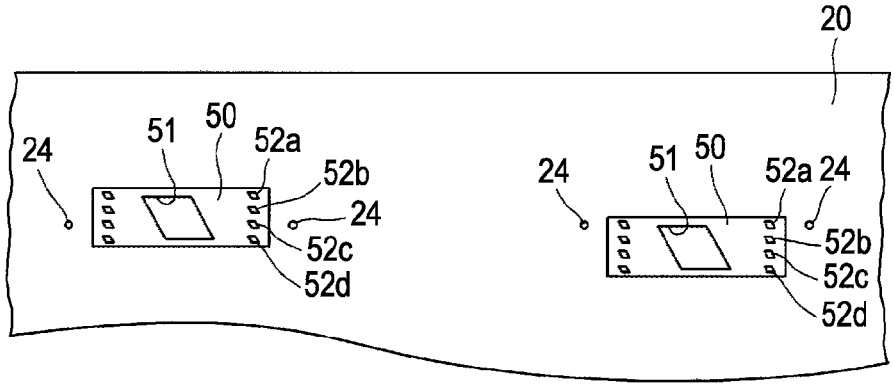
FIG. 6A is a partial enlarged diagram illustrating a base plate prior to the attachment of a head.

To be more specific, as shown in FIG. 6A, with the anchoring plate 40 and the reference plate 50 corresponding to a head 10*a* in a single head group 100*a*, the reference plate 50, or in other words, the anchoring plate 40 is disposed using the positioning of the pair of positioning holes 52*c* relative to the pair of reference holes 24. Meanwhile, with the anchoring plate 40 and the reference plate 50 corresponding to a head 10*a* in the head group 100*b* that is adjacent to the head group 100*a*, a different reference plate 50, or in other words, the anchoring plate 40, is disposed using the positioning of the pair of positioning holes 52*a* relative to the reference holes 24. By disposing the plates in this manner, a certain anchoring plate 40 can be disposed having been shifted relative to the other anchoring plate 40 by an amount equivalent to the interval d between two positioning holes 52, or in other words, at half the pitch in the nozzle rows 14 direction. In this case, by forming two rows of positioning holes 52, it is easy to carry out the positioning after confirming whether or not the pair of positioning holes 52 selected with respect to the pair of reference holes 24 through image processing are respectively in the same direction in the nozzle row direction, and thus it is not necessary to carry out the positioning by correcting the adjustment position (that is, changed the angle) during image processing.

Figure 6B:
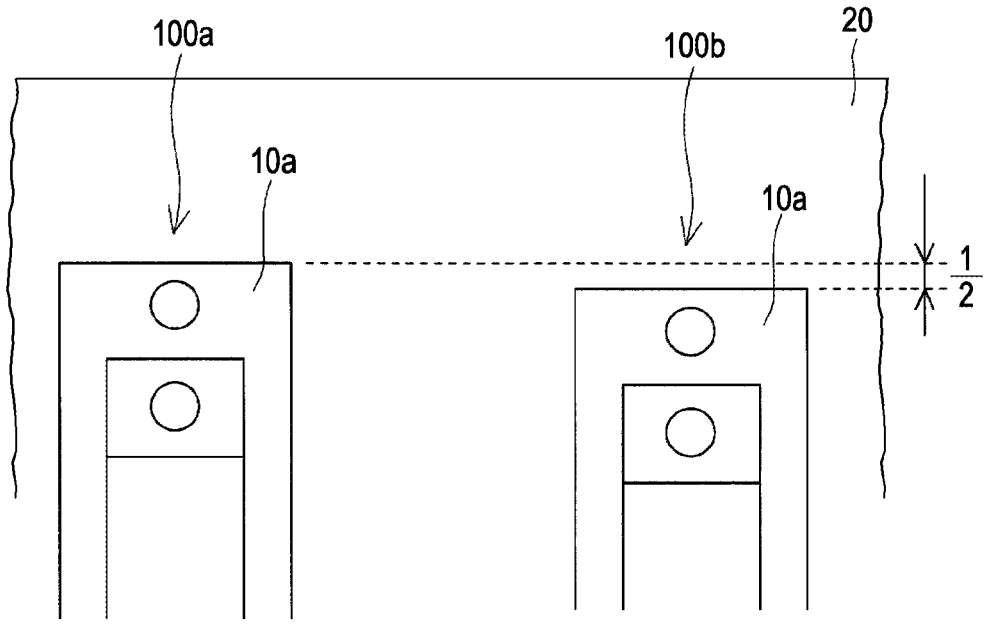
FIG. 6B is a partial enlarged diagram illustrating the base plate after the attachment of the head.
Figure 7A:
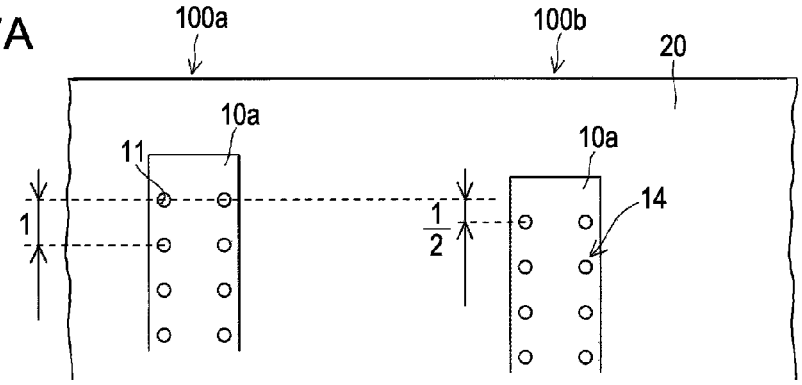
FIGS. 7A-7C are partial enlarged diagrams viewing a base plate from its rear side.

Then, when the heads 10*a* are disposed as described above using the positioning pins 23 and using these reference plates 50 as references, as shown in FIG. 6B, the head 10*a* in the head group 100*b* is disposed having been shifted relative to the head 10*a* of the head group 100*a* by an amount equivalent to half the pitch in the nozzle row 14 direction. By disposing the heads 10 in this manner, the nozzles 11 of the head 10*a* in the head group 100*a* are shifted relative to those of the head 10*a* in the head group 100*b* by an amount equivalent to half the pitch, and therefore the number of nozzles in the nozzle row 14 direction is doubled, as shown in FIG. 7A. Accordingly, when, for example, the resolution of the single head 10 is 180 dpi, the resolution of the head unit 1 is 360 dpi.

Figure 7B:
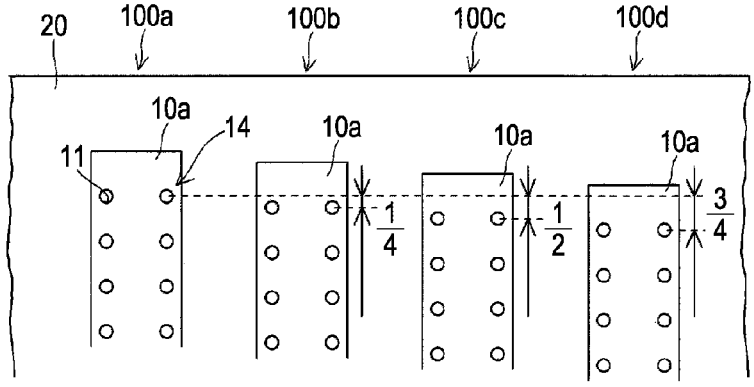

In addition, in the case where, for example, four head groups 100 (100*a* to 100*d*) are used in a single head unit 1, disposing the heads 10*a* of which each head group 100 is configured shifted by ¼ the nozzle pitch relative to the heads 10*a* of which the respective adjacent head groups 100 are configured, using the heads 10*a* of which the head group 100*a* is configured as a reference, as shown in FIG. 7B, results in a resolution of 720 dpi for the head unit 1. In this case, the reference plate 50 corresponding to the heads 10*a* of which the head group 100*a* is configured may use the positioning hole 52*d* in the positioning, the reference plate 50 corresponding to the heads 10*a* of which the head group 100*b* is configured may use the positioning hole 52*c* in the positioning, the reference plate 50 corresponding to the heads 10*a* of which the head group 100*c* is configured may use the positioning hole 52*b* in the positioning, and the reference plate 50 corresponding to the heads 10*a* of which the head group 100*d* is configured may use the positioning hole 52*a* in the positioning to the reference hole 24.

In this manner, the configuration of this embodiment is such that multiple positioning holes 52 are provided and which of those positioning holes 52 are to be used can be determined based on the desired resolution; therefore, each head unit 1 can be manufactured with different resolutions without increasing the number of components. For example, in the case where only a single positioning hole 52 is provided, it is necessary to change the location in which the positioning hole is formed based on the resolution, leading to an increase in the number of components; however, this is not necessary with this embodiment.

Figure 7C:
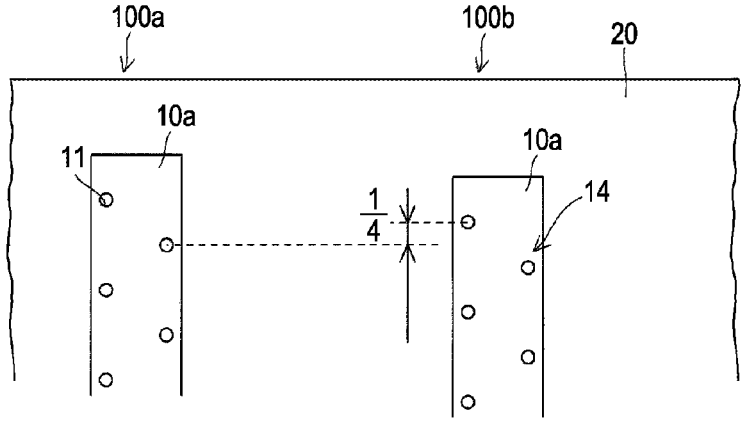

In addition, as shown in FIG. 7C, in the case where the two nozzle rows 14 in each head 10 are shifted relative to each other by half of the nozzle pitch (that is, the case where the heads 10 are 360 dpi), the heads may be shifted by half of that half-pitch, or in other words, by a pitch that is ¼ the space between the nozzles 11 in the rows. To be more specific, the reference plate 50 corresponding to the heads 10*a* of which the head group 100 is configured may use the positioning holes 52*b* in the positioning relative to the reference holes 24, and the reference plate 50 corresponding to the heads 10*a* of which the head group 100*b* is configured may use the positioning holes 52*a* in the positioning relative to the reference holes 24. In this manner, even in the case where the nozzle rows 14 in the respective heads 10 are shifted relative to each other, the positioning holes 52 according to this embodiment make it possible to form the head unit 1 without increasing the number of components.

Other Embodiments

Although an exemplary embodiment of the invention has been described thus far, the invention is not limited to the aforementioned embodiment. Although the positioning holes 52 are described in the embodiment as holes that are formed through etching, the invention is not limited thereto, and the positioning holes 52 may have any form as long as they are marks that serve as a reference for positioning. For example, the positioning holes 52 may be positioning marks formed in the anchoring plates 40 and the base plate 20 using a laser. Furthermore, although the aforementioned embodiment describes four positioning holes 52, the invention is not limited thereto. If, for example, there are eight positioning holes 52, resolutions from 180 dpi to a maximum of 1440 dpi can be achieved through selection of positioning holes 52.

Furthermore, although the aforementioned embodiment describes the positioning holes 52 as having the same shape, size, and so on, the positioning holes 52 may be configured so as to differ from each other. Configuring the positioning holes 52 so as to differ from each other makes it easier to identify which positioning holes 52 are selected when selecting the positioning holes 52, thereby making it easy to position the positioning holes 52 relative to the reference holes 24 with high accuracy.

Figure 8:
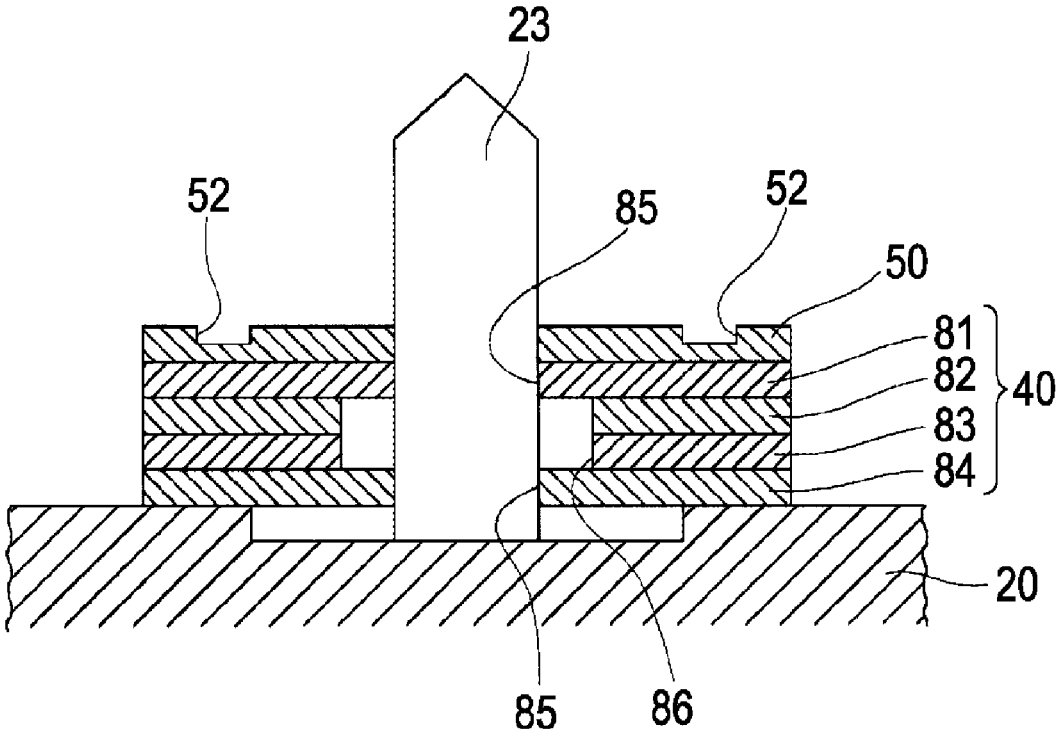
FIG. 8 is a partial enlarged diagram illustrating a cross-section of a base plate.

Although the anchoring plate 40 is described in the aforementioned embodiment as being configured of a single member, the anchoring plate 40 may be configured from multiple members. For example, as shown in FIG. 8, the anchoring plate 40 located beneath the reference plate 50 in which the positioning holes 52 are formed is configured of multiple thin guide plates 81 to 84, and opening portions 85, into which the positioning pin 23 is fitted, are formed in the uppermost guide plate 81 and the lowermost guide plate 84. Meanwhile, communicating opening portions 86, which communicate with the opening portions 85 and whose edge portions are provided so as to be located further outside than the edges of the opening portions 85, are provided in the middle guide plates 82 and 83. The positioning pin 23 is erected in an indented portion of the base plate 20 and is held vertically by the opening portions 85. By employing such a configuration in which the positioning pin 23 is held by the opening portions 85 of the guide plates 81 and 84, even if the opening portions 85 are formed in a slanted fashion, the influence thereof is small or is of a degree that can be ignored, and thus the positioning accuracy is high. In other words, when the anchoring plate 40 is configured of a single member, the accuracy may drop due to one of the openings of the through-hole 51 being formed shifted relative to the other opening in the planar direction; however, in this embodiment, the opening portions 85 are formed in the thin guide plates 81 and 84, and thus there is little shift. As a result, the positioning pin can be erected vertically in an accurate manner, and thus the positioning accuracy does not decrease. Although the reference plate 50 is provided above the uppermost guide plate 81 here, it should be noted that the uppermost guide plate 81 may be used as the reference plate 50 instead. A positioning hole 52 may then be provided in the guide plate 81.

Furthermore, although the aforementioned embodiment describes two nozzle rows 14 as being provided in each head 10, the invention is not particularly limited thereto, and, for example, a single nozzle row 14 may be provided in each head 10, or three or more nozzle rows 14 may be provided in each head 10. Likewise, although the aforementioned embodiment describes the head groups 100 as being configured of three heads 10, the invention is not particularly limited thereto, and each head group 100 may be configured of two heads 10, or may be configured of four or more heads 10.

Furthermore, although the aforementioned embodiment describes two head groups 100 as being provided in the head unit 1, the invention is not particularly limited thereto, and there may be only one head group 100, or three or more head groups 100.

In addition, although each head 10 is described in the aforementioned embodiment as including the subplate 30, the invention is not particularly limited thereto; the positioning plate 60 may be attached directly to the head case 13, and the head case 13 may then be positioned relative and anchored to the base plate 20.

Furthermore, although each head 10 is described in the aforementioned embodiment as including the positioning plate 60 in which the tip through-hole 61 is formed, the tip through-hole 61 may, for example, be formed in a member of which the head 10 is configured, such as the head case 13.

Figure 9:
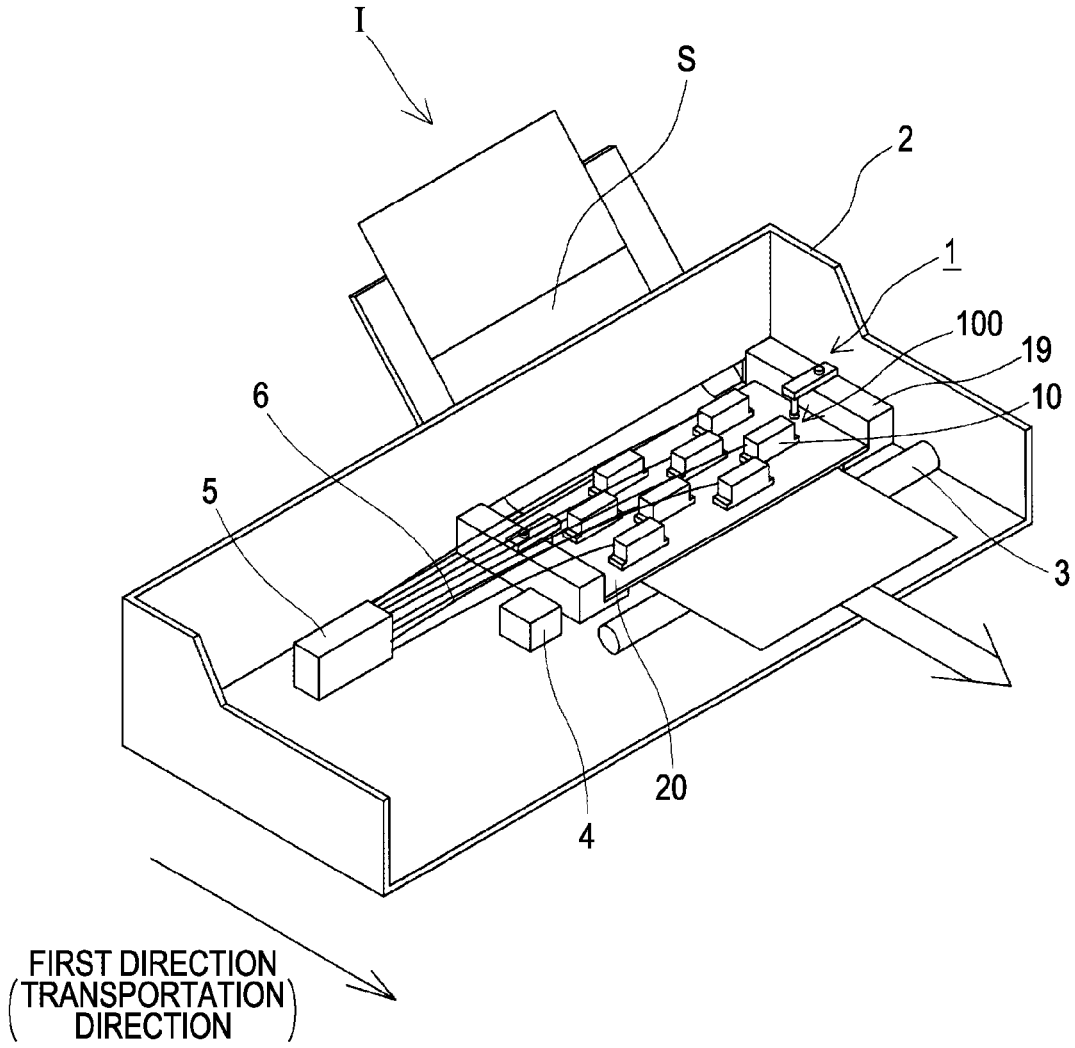
FIG. 9 is a perspective view illustrating an outline of a liquid ejecting apparatus.

The head unit according to the invention can be applied in what is known as a line-type ink jet recording apparatus or the like that prints onto a recording medium such as recording paper by transporting the recording medium in the direction orthogonal to the direction of the nozzle rows. For example, an ink jet recording apparatus I as shown in FIG. 9 includes the aforementioned head unit 1, an apparatus main body 2, a supply roller 3, which is an example of a moving unit, and a controller 4.

The head unit 1 includes a frame member 19 which is attached to the base plate 20 that holds the head groups 100 configured of multiple heads 10 (note that in FIG. 9, each head group 100 is configured of four heads 10), and the head unit 1 is anchored to the apparatus main body 2 via this frame member 19.

Furthermore, the supply roller 3 is provided in the apparatus main body 2. The supply roller 3 transports a recording sheet S (an ejection target medium) such as paper supplied to the apparatus main body 2 in a first direction, and causes the recording sheet S to pass under the surfaces of the heads 10 from which ink is discharged. Here, the first direction refers to the direction in which the recording sheet S moves relative to the heads 10. In this embodiment, the head unit 1 is anchored to the apparatus main body 2, and thus the direction in which the recording sheet S is transported by the supply roller 3 is the first direction. The first direction will be referred to as the transportation direction hereinafter.

Furthermore, an ink holding unit 5 that holds ink is provided in the apparatus main body 2, and the ink is supplied to the heads 10 via supply pipes 6.

Although details will be given later, based on print data expressing an image to be printed on the recording sheet S, the controller 4 transmits signals to the supply roller 3 so as to cause the recording sheet S to be transported, and causes ink to be ejected from the heads 10 by sending driving signals thereto via wiring (not shown).

With this ink jet recording apparatus I, the recording sheet S is transported in the transportation direction by the supply roller 3, and an image or the like is printed onto the recording sheet S by ink being ejected by the heads 10 of the head unit 1. In this case, by being provided with the ink jet recording head unit according to the invention, the ink jet recording apparatus can be manufactured without increasing the number of components based on the resolution thereof, and also has high ink ejection properties due to the highly accurate positioning.

In addition, the head unit of the invention can be applied not only to a line-type ink jet recording apparatus such as that shown in FIG. 9, but also to other types of ink jet recording apparatuses as well. For example, the head unit of the invention can be applied to an ink jet recording apparatus of a type that carries out printing while causing a carriage in which the head unit is installed to move in a direction that is orthogonal to the transportation direction of the recording medium.

Of course, the ink jet recording apparatus is merely one example of a liquid ejecting apparatus, and the invention can be applied to other liquid ejecting apparatuses aside from ink jet recording apparatuses.

What is claimed is:

1. A manufacturing method for a liquid ejecting head unit, the liquid ejecting head unit comprising:

a plurality of liquid ejecting heads, each liquid ejecting head having a nozzle row in which nozzles that eject a liquid are arranged in a row;

a base plate to which the plurality of liquid ejecting heads are anchored;

an anchoring plate, anchored to the base plate, for positioning the liquid ejecting heads in predetermined positions relative to the base plate; and a reference mark formed in the anchoring plate and a positioning mark formed in the base plate for positioning the anchoring plate relative to the base plate, wherein a plurality of the positioning marks are formed along the direction in which the nozzles are arranged in a row, and the manufacturing method includes:

selecting the positioning mark in accordance with a predetermined resolution;

anchoring the anchoring plate to the base plate so that the reference mark and the selected positioning mark are in the same relative positional relationship; and anchoring the liquid ejecting heads to the base plate using the anchoring plate.

2. The manufacturing method for a liquid ejecting head unit according to claim 1, wherein the positioning marks are holes that are formed in the base plate.

3. The manufacturing method for a liquid ejecting head unit according to claim 1, wherein at least one of the shape and size of the positioning marks differs in each of positioning mark.

4. The manufacturing method for a liquid ejecting head unit according to claim 1, wherein a plurality of rows of the positioning marks are formed in the anchoring plate along the direction that is orthogonal to the direction in which the nozzles are arranged in rows.

5. The manufacturing method for a liquid ejecting head unit according to claim 1, wherein a positioning pin is provided in the anchoring plate, and a through-hole through which the positioning pin passes is provided in each of the liquid ejecting heads; the method comprising:

anchoring each of the liquid ejecting heads to the base plate by passing the positioning pin through the through-hole.

6. A liquid ejecting apparatus comprising a liquid ejecting head that includes:

a plurality of liquid ejecting heads, each liquid ejecting head having a nozzle row in which nozzles that eject a liquid are arranged in a row;

a base plate to which the plurality of liquid ejecting heads are anchored;

an anchoring plate, anchored to the base plate, for positioning the liquid ejecting heads in predetermined positions relative to the base plate; and a reference mark formed in the anchoring plate and a positioning mark formed in the base plate for positioning the anchoring plate relative to the base plate, wherein a plurality of the positioning marks are formed along the direction in which the nozzles are arranged in a row.

7. The liquid ejecting apparatus according to claim 6, wherein the positioning marks are holes that are formed in the base plate.

8. The liquid ejecting apparatus according to claim 6, wherein at least one of the shape and size of the positioning marks differs in each of positioning mark.

9. The liquid ejecting apparatus according to claim 6, wherein a plurality of rows of the positioning marks are formed in the anchoring plate along the direction that is orthogonal to the direction in which the nozzles are arranged in rows.

10. The liquid ejecting apparatus according to claim 6, wherein the liquid ejecting head is manufactured according a method that includes:

selecting the positioning mark in accordance with a predetermined resolution;

anchoring the anchoring plate to the base plate so that the reference mark and the selected positioning mark are in the same relative positional relationship; and anchoring the liquid ejecting heads to the base plate using the anchoring plate.

11. The liquid ejecting apparatus according to claim 6, wherein a positioning pin is provided in the anchoring plate, and a through-hole through which the positioning pin passes is provided in each of the liquid ejecting heads.

12. The liquid ejecting apparatus according to claim 11, wherein the liquid ejecting head is manufactured according a method that includes:

selecting the positioning mark in accordance with a predetermined resolution;

anchoring the anchoring plate to the base plate so that the reference mark and the selected positioning mark are in the same relative positional relationship; and anchoring the liquid ejecting heads to the base plate using the anchoring plate.

13. The liquid ejecting apparatus according to claim 12, wherein the method further comprises:

anchoring each of the liquid ejecting heads to the base plate by passing the positioning pin through the through-hole.

* * * * *